United States Patent [19]

Jodoin et al.

[11] Patent Number: 4,765,129

[45] Date of Patent: Aug. 23, 1988

[54] METHOD FOR SPLICING FILAMENTARY MATERIAL AND HOLDING DEVICES THEREFOR

[75] Inventors: Francois Jodoin, St. Constant; Jean M. Roberge, Kirkland, both of Canada

[73] Assignee: Northern Telecom Limited, Montreal, Canada

[21] Appl. No.: 78,438

[22] Filed: Jul. 27, 1987

[51] Int. Cl.[4] ..... D01H 15/00

[52] U.S. Cl. ..... 57/72

[58] Field of Search ..... 57/22, 261, 262, 263

[56] References Cited

U.S. PATENT DOCUMENTS

| | | | |
|---|---|---|---|
| 3,307,339 | 3/1967 | Porter | 57/22 |
| 3,903,680 | 9/1975 | Isern | 57/22 |
| 4,397,138 | 8/1983 | Rohner et al. | 57/22 |
| 4,407,117 | 10/1983 | Garnsworthy | 57/22 |
| 4,494,367 | 1/1985 | Badiali | 57/22 |
| 4,506,497 | 3/1985 | Fauerlohn | 57/22 |
| 4,590,753 | 5/1986 | Bertoli et al. | 57/22 |

*Primary Examiner*—Donald Watkins

*Attorney, Agent, or Firm*—R. J. Austin; C. W. Junkin

[57] ABSTRACT

In a method for splicing filaments, respective end portions of two filaments are held in overlapping condition in a holding device comprising two axially spaced rubber holders, each holder having a radial slot for receiving and retaining the overlapped end portions. One of the holders is rotated relative to the other to twist together the overlapping end portions. The holders are then fixed against relative rotation, and the twisted together end portions are fused together to form a splice of substantially circular cross-section. The method and device are useful for splicing plastic coated glass yarn used to reinforce telecommunications cables.

15 Claims, 4 Drawing Sheets

METHOD FOR SPLICING FILAMENTARY MATERIAL AND HOLDING DEVICES THEREFOR

Figure 1:
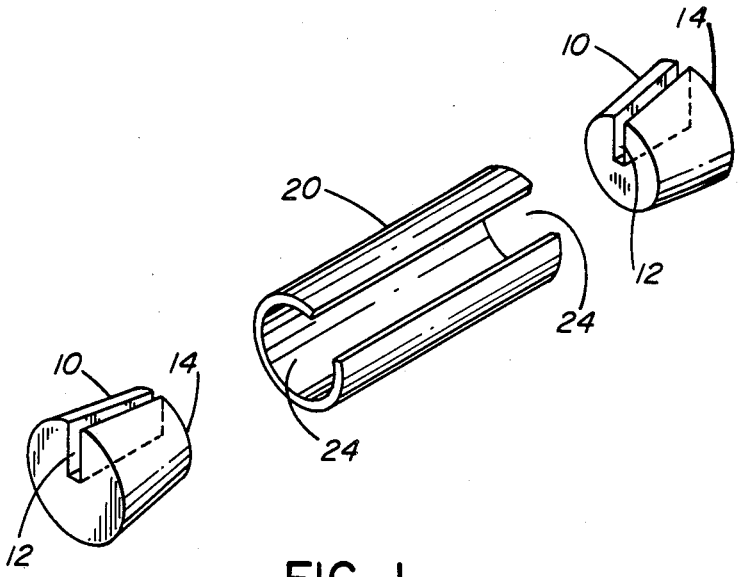

The present invention relates to a method for splicing filamentary material and holding devices therefor.

Plastic coated glass yarn is used to reinforce telecommunication cable structures against tensile loading. During cable manufacture, the yarn is paid off from packages through guiding structures into an extruder cross-head to be embedded in an extruded cable jacket. When the end of a package is reached, or in the event of breakage, the yarn must be spliced to provide end-to-end continuity within the cable.

The present invention provides a method for splicing filamentary material and holding devices useful in the performance of that method.

According to one aspect of the invention, there is provided a method for splicing filamentary material, comprising overlapping respective end portions of two pieces of filamentary material by arranging the pieces to extend in opposite directions with the respective end portions along side one another, twisting the overlapped end portions together and treating the twisted end portions to cause the twisted end portions to adhere to one another.

Each end portion may be longitudinally split to form two adjacent end sections, and one of these end sections may be removed from each end portion before twisting the end portions together. This provides a splice having a substantially circular cross-section of diameter substantially equal to the diameter of the filaments.

Preferably, the pieces of filamentary material are held in overlapping condition at two axially spaced holding positions and rotated at one holding position with respect to the other holding position to twist the overlapped end portions together. It is also preferable to apply tension to the filamentary material between the holding positions while heating the twisted end portions to cause the twisted end portions to fuse together.

According to another aspect of the invention, there is provided a device for holding filamentary material during splicing, comprising a pair of holding means locatable in axially spaced positions for holding respective end portions of two pieces of filamentary material in overlapping condition, said holding means being rotatable one with respect to the other to twist together the end portions, and rotation resisting means for resisting rotation of the holding means one with respect to the other to enable the twisted end portions to be treated to cause the twisted end portions to adhere to one another.

Each holding means may comprise a resilient holder having a slot opening onto a peripheral surface of the holder and extending axially through the holder for receiving and holding the end portions in an overlapping condition. Conveniently, each holder is circular in cross-section, and each opening is a slot extending radially inward from the circumference of the holder.

The rotation resisting means may comprise a sleeve having open ends for receiving and retaining the holders, one at each end of the sleeve, and a lateral opening extending between the ends of the sleeve for permitting lateral movement of the filamentary material into and out of the sleeve. The holders are rotatable one with respect to the other when separate from the sleeve, but the sleeve frictionally resists relative rotation of the holders when the holders are received therein.

Alternatively, the rotation resisting means may comprise a pair of spaced supports for supporting the holders in axially spaced positions, one of the holders being fixed against rotation on its support, and the other of the holders being manually rotatable against a frictional braking force on its support.

Figure 3:
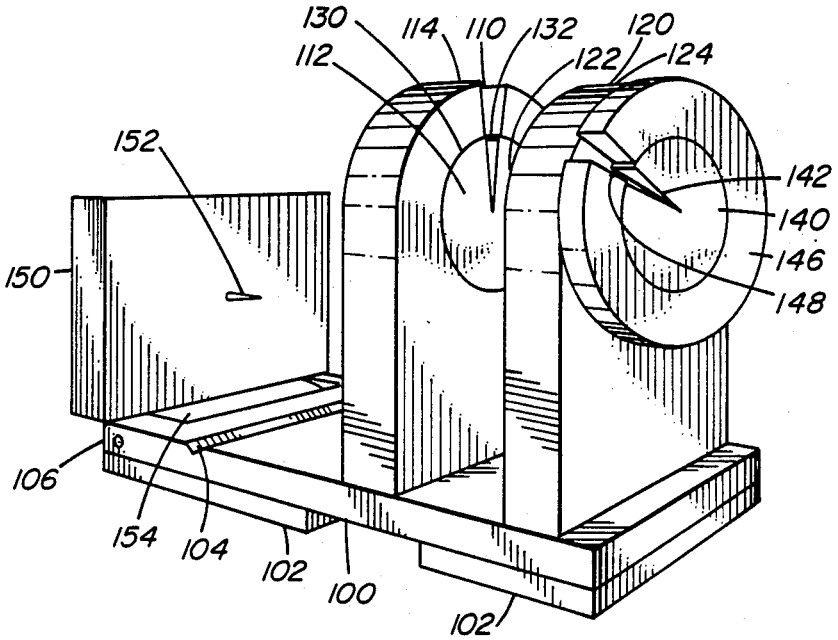
Figure 4:
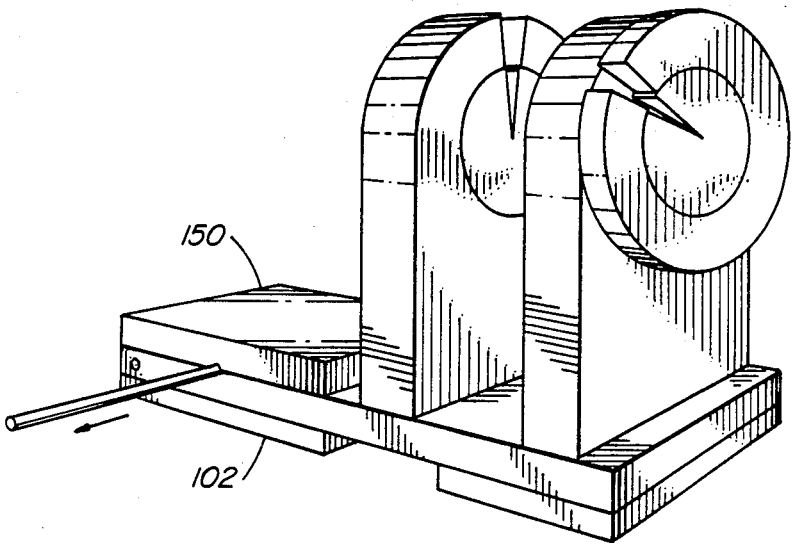

Embodiments of the invention will now be described, by way of example only, with reference to the accompanying drawings in which:

FIG. 1 shows a device according to a first embodiment for holding filamentary material during splicing;

FIGS. 2*a* through 2*h* show end portions of a pair of filaments at successive stages of splicing using the device of FIG. 1;

FIG. 3 shows a device according to a second embodiment for holding filamentary material during splicing; and FIG. 4 is a fragmentary view of the device of FIG. 3 showing a yarn splitting tool in operation.

Referring to FIG. 1, a holding device according to the first embodiment comprises a pair of holding means in the form of heat resistant rubber holders 10 and a rotation resisting means in the form of a steel sleeve 20 for resisting relative rotation of the holders as will be described below. Each holder 10 is a frustum with a circular cross-section, and has a slot 12 extending axially therethrough and radially inwards from its circumferential peripheral surface 14. The sleeve 20 is circumferentially discontinuous to provide a radial opening 22 extending between end openings 24 of the sleeve. The end openings 24 are for receiving and frictionally retaining the holders 10, one at each end.

Figure 2A:
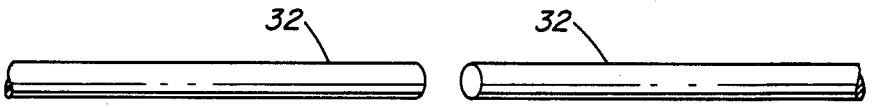
Figure 2B:
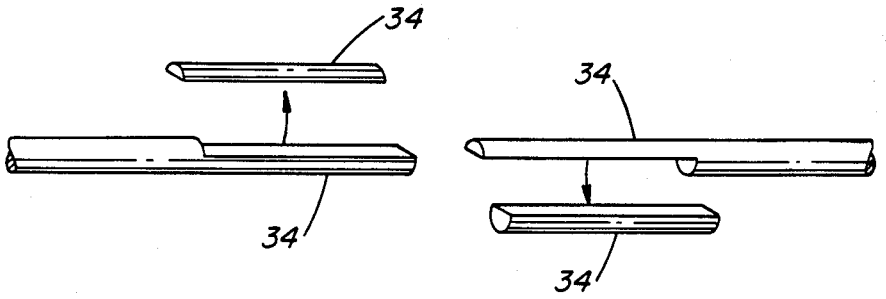
Figure 2C:
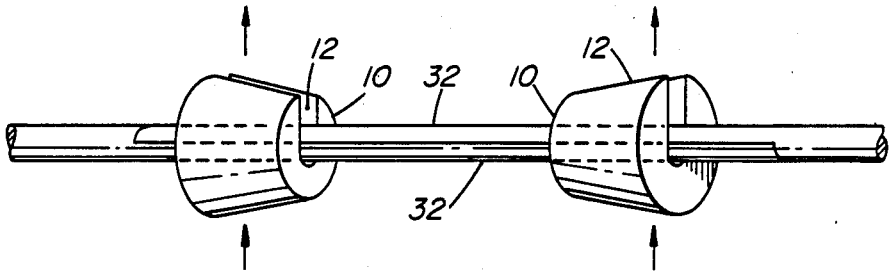
Figure 2D:
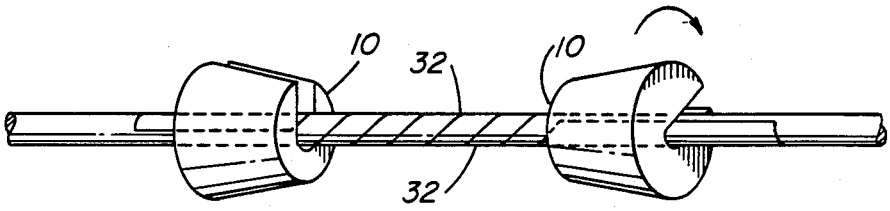
Figure 2E:
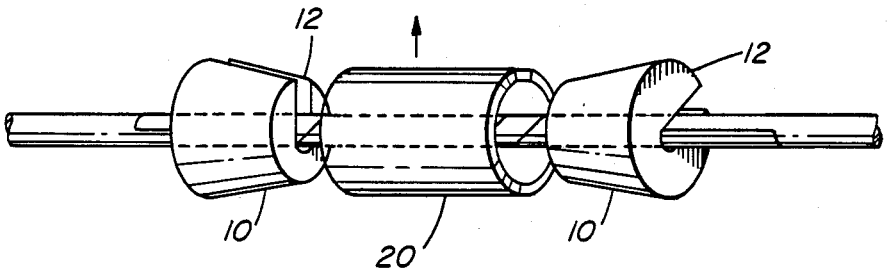
Figure 2F:
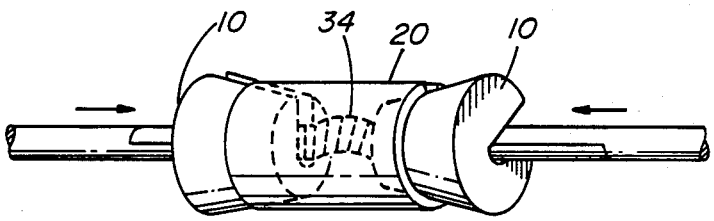
Figure 2G:
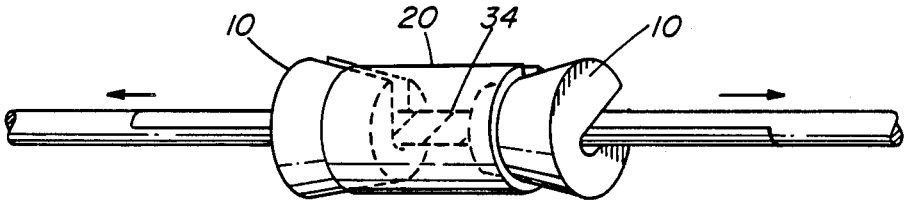
Figure 2H:
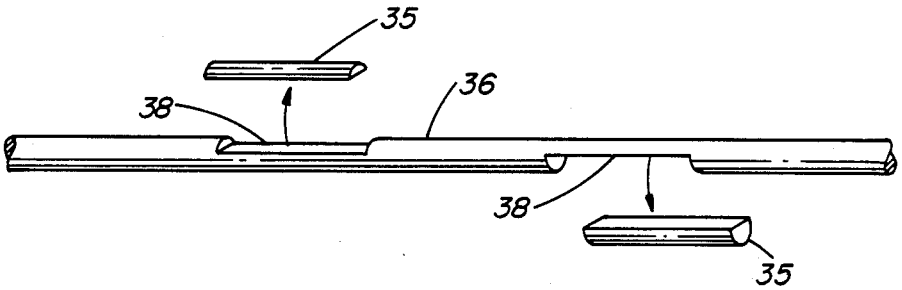

In use of the holding device, each of two end portions 32 of respective pieces of yarn (FIG. 2*a*) is longitudinally split to form two adjacent end sections 34, one of which is removed from each end portion (FIG. 2*b*). The remaining end portions are held in overlapping condition by inserting them into the slots 12 of the holders 10 which are axially spaced at two holding positions by a distance slightly greater than the length of the sleeve 20 (FIG. 2*c*). The holders 10 deform resiliently to grip the end portions 32 in the slots 12. The overlapping end portions between the holders are twisted together by rotating one of the holders with respect to the other (FIG. 2*d*), the sleeve is placed over the twisted end portions which pass through lateral opening 22 of the sleeve (FIG. 2*e*), and the holders are moved axially into the sleeve to frictionally fix them against relative rotation in an axially spaced condition (FIG. 2*f*). The pieces of yarn are pulled to straighten the twisted end portions between the holders (FIG. 2*g*) and heat is applied through the lateral opening 22 to fuse the twisted end portions together. Tension is applied to the yarn during heating and subsequent cooling to ensure that the twisted end portions are in firm contact and fuse together thoroughly. The fused end portions are removed from the fixture, and any unfused end portions 35 are trimmed off (FIG. 2*h*).

Note that the method described above provides a central splice region 36 with a substantially circular cross-section of diameter substantially equal to the yarn diameter. As shown in FIG. 2*h*, trimming of unfused end portions 35 may leave thinner non-circular regions 38 at each end of the splice region. While these thinner regions may be acceptable in some applications, they can be avoided by ensuring that the split end portion of each piece of yarn extends beyond the split end portion of the other piece of yarn when the pieces of yarn are overlapped, and that the entire region where two split end portions overlap is twisted together and fused. Alternatively, the end portions can be twisted together and fused without first splitting them, but in this case, the splice region will have a substantially circular cross-section of diameter greater than the yarn diameter.

Referring to FIG. 3, a holding device according to the second embodiment comprises a frame in the form of an elongate member 100 carrying a pair of permanent magnets 102 on a lower surface. The member 100 has a groove 104 extending laterally across its surface adjacent one end 106 of the member.

The member 100 carries a pair of axially spaced supports 110, 120 on its upper surface at locations axially spaced from the groove 104. Each support has a respective bore 112, 122 extending axially therethrough, and is laterally open at a respective axially extending slot 114, 124 which communicates with its associated bore.

A resilient holder 130 is fixed against rotation in the bore 112 of one support 110. The holder is circular in cross-section and has an opening in the form of a slot 132 extending radially inward from the circumference of the holder. The slot 132 is aligned with the slot 114 of the support.

Another resilient holder 140 is carried in the bore 122 of the other support 120. This holder is also circular in cross-section, and also has an opening in the form of a slot 142 extending radially inward from its circumference. The holder 140 is manually rotatable in the bore 122 against a braking force resulting from friction between the holder 140 and the support 120. Thus, the slot 142 is alignable with the slot 124 by manual rotation of the holder 140 but is fixed against rotation in the absence of manual force. The holder 140 is provided with a radially extending gripping flange 146 at one end to facilitate its manual rotation. The flange 146 has a radial slot 148 aligned with the slot 142 of the holder 140.

A member in the form of a plate 150 is pivotally connected at the end 106 of the member 100 adjacent the groove 104. The plate carries a needle point 152 projecting in a direction normal to its surface, the plate being pivotable upon a hinge 154 from a position clear of the groove toward the upper surface of the member 100 into a position in which the needle point enters the groove from above.

In use of the holding device according to the second embodiment, the holding device is removably mounted on a cable manufacturing apparatus by means of the magnets 102. With the plate 150 pivoted away from the groove 104, a yarn end portion is placed in the groove, and the plate is then pivoted toward the groove so that the needle penetrates the yarn. The yarn is then withdrawn along the slot as shown in FIG. 4 to split the yarn end portion into two end sections with the needle point 152. One of the end sections is trimmed off the end portion and discarded to provide a yarn end portion similar to those shown in FIG. 2*b*. A second yarn end portion is prepared in the same manner.

With the slot 142 of the rotatable holder aligned with the slot 124 of the support !20, the prepared yarn end portions are inserted into the slots 114, 124 of the supports 110, 120 into the slots 132, 142 of the holders to overlap them in the manner shown in FIG. 2*c*. Then, with the fiber end portions held in overlapping relationship by the holders, the rotatable holder 140 is manually rotated to twist the yarn end portions together. The twisted end portions extending between the holders are then heated to fuse them together. The frictional braking force exerted on the rotatable holder 140 by its support 120 is sufficient to fix the rotatable holder against rotation due to the tendency of the twisted end portions to untwist during heating of the yarn. Once the twisted end portions are fused together, the slot 142 of the rotatable holder is aligned with the slot 124 of its support and the fused yarn end portions are removed from the holders through the slots 114, 124 of the supports. Unfused end portions are trimmed off as described above.

Note that other methods of treating the twisted together end portions to cause them to adhere to one another may be used. For example, a suitable solvent could be applied to the twisted together end portions to cause them to fuse together, or an adhesive could be applied to cause them to adhere to one another.

What is claimed is:

1. A method for splicing filamentary material comprising overlapping respective end portions of two pieces of filamentary material by arranging the pieces to extend in opposite directions with respective end portions of the pieces alongside one another, holding the pieces of filamentary material at two axially spaced holding positions and rotating the filamentary material at one holding position with respect to the filamentary material at the other holding position to twist the overlapped end portions together, and treating the twisted end portions to cause the twisted end portions to adhere to one another.

2. A method as defined in claim 1, comprising applying tension to the filamentary material between the holding positions while heating the twisted end portions to cause the twisted end portions to fuse together.

3. A method as defined in claim 1, or 2 comprising longitudinally splitting each end portion to form two adjacent end sections, and removing one of said end sections from each end portion before twisting the end portions together.

4. A method as defined in claim 1, comprising:

holding the pieces of filamentary material in overlapping condition in two axially spaced holding means, one holding means located at each of said holding positions;

rotating one holding means with respect to the other holding means to twist the overlapped end portions together; and engaging the holding means with rotation resisting means to resist relative rotation of the holding means while treating the twisted end portions to cause the twisted end portions to adhere to one another.

5. A method as defined in claim 1, comprising:

holding the pieces of filamentary material in overlapping condition in two axially spaced resilient holders, one holder located at each of said holding positions, each holder having a slot opening onto a peripheral surface of the holder and extending through the holder for receiving and holding the end portions in overlapping condition;

rotating one holder with respect to the other holder to twist the overlapped end portions together and locating a sleeve between the holders by passing the overlapped end portions through a lateral opening extending between pen ends of the sleeve;

frictionally fitting the holders one into each open end of the sleeve to resist relative rotation of the holders; and heating the twisted together end portions through the lateral opening of the sleeve to fuse the twisted end portions together.

6. A device for holding filamentary material during splicing, comprising a pair of holding means locatable in axially spaced positions for holding respective end portions of two pieces of filamentary material in overlapping condition, said holding means being rotatable one with respect to the other to twist together the end portions, and rotation resisting means for resisting rotation of the holding means one with respect to the other.

7. A device for holding filamentary material during splicing, comprising a pair of resilient holders each having a slot opening onto a peripheral surface of the holder and extending axially through the holder for receiving and holding respective end portions of two pieces of filamentary material in an overlapping condition, the holders being rotatable one with respect to the other to twist together the end portions, and a sleeve having open ends for receiving and retaining the holders, and a lateral opening extending between the open ends of the sleeve for permitting lateral movement of the filamentary material into and out of the sleeve, the holders being rotatable one with respect to the other when separate from the sleeve and the sleeve frictionally resisting relative rotation of the holders when the holders are received therein.

8. A device as defined in claim 7, wherein each holder is circular in cross-section, and each slot extends radially inward from the circumference of the holder.

9. A device for holding filamentary material during splicing, comprising a pair of of resilient holders each having a slot opening onto a peripheral surface of the holder and extending axially through the holder for receiving and holding respective end portions of two pieces of filamentary material in an overlapping condition, the holders being rotatable one with respect to the other to twist together the end portions, and a pair of spaced supports for supporting the holders in axially spaced postions, one of the holders being fixed against rotation on its support, and the other of the holders being manually rotatable against a frictional braking force on its support.

10. A device as defined in claim 9, wherein each holder is circular in cross-section, and each slot extends radially inward from the circumference of the holder, each support being laterally open to permit access to the slot of its respective holder.

11. A device as defined in claim 10, wherein the rotatable holder is provided with a radially extending gripping flange.

12. A device as defined in claim 9, wherein the supports are mounted to a common frame.

13. A device as defined in claim 12, further comprising means for splitting a filamentary material comprising:

a first member having a groove for receiving filamentary material; and a second member carrying a needle point, the second member being movably connected to the first member for movement between a first position in which the second member is clear of the groove and a second position in which the needle point enters the groove from a direction transverse to the groove.

14. A device as defined in claim 13, wherein the first member is integral with the frame, and the second member is pivotally connected to the first member for pivotal movement between the first and second positions.

15. A device as defined in claim 12, wherein the frame is provided with a magnet for removably mounting the device to cable making apparatus.

* * * * *